US008839835B2

(12) United States Patent
Benner et al.

(10) Patent No.: US 8,839,835 B2
(45) Date of Patent: Sep. 23, 2014

(54) SYSTEMS AND METHODS FOR CONTINUOUS DELIVERY OF WEB MATERIALS

(75) Inventors: James Jay Benner, Morrow, OH (US); Patrick John Healey, West Chester, OH (US); Jose Mauricio Berrizbeitia, Deerfield Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 831 days.

(21) Appl. No.: 12/544,268

(22) Filed: Aug. 20, 2009

(65) Prior Publication Data

US 2011/0042012 A1 Feb. 24, 2011

(51) Int. Cl.
*B32B 37/12* (2006.01)

(52) U.S. Cl.
USPC ..... 156/504; 156/157; 156/502; 242/551; 242/552; 242/554; 242/555; 242/555.3; 242/555.4; 242/555.5

(58) Field of Classification Search
None
See application file for complete search history.

(56) References Cited

U.S. PATENT DOCUMENTS

| | | | | |
|---|---|---|---|---|
| 3,860,003 | A | | 1/1975 | Buell |
| 4,472,783 | A | | 9/1984 | Johnstone et al. |
| 4,708,300 | A | * | 11/1987 | Goetz ..... 242/551 |
| 5,151,092 | A | | 9/1992 | Buell et al. |
| 5,383,988 | A | | 1/1995 | Herrmann et al. |
| 5,492,591 | A | | 2/1996 | Herrmann et al. |
| 5,554,145 | A | | 9/1996 | Roe et al. |
| 5,569,234 | A | | 10/1996 | Buell et al. |
| 5,580,411 | A | | 12/1996 | Nease et al. |
| 5,868,899 | A | | 2/1999 | Gundersen |
| 6,004,306 | A | | 12/1999 | Robles et al. |
| 6,074,333 | A | | 6/2000 | Rajala et al. |
| 6,349,237 | B1 | | 2/2002 | Koren et al. |
| 6,574,520 | B1 | | 6/2003 | Liu et al. |
| 6,788,987 | B2 | | 9/2004 | Slechta et al. |
| 6,990,715 | B2 | | 1/2006 | Liu et al. |
| 7,984,603 | B2 | * | 7/2011 | Freudenberg et al. ..... 53/389.1 |
| 2002/0148548 | A1 | | 10/2002 | Murie et al. |
| 2002/0151422 | A1 | | 10/2002 | Duhm et al. |
| 2004/0162536 | A1 | | 8/2004 | Becker et al. |
| 2006/0286343 | A1 | | 12/2006 | Curro et al. |
| 2007/0197987 | A1 | | 8/2007 | Tsang et al. |
| 2007/0213678 | A1 | | 9/2007 | Thorson et al. |
| 2010/0078119 | A1 | | 4/2010 | Yamamoto et al. |
| 2010/0170202 | A1 | | 7/2010 | Bray et al. |

FOREIGN PATENT DOCUMENTS

DE 40 18 266 A1 12/1991

(Continued)

OTHER PUBLICATIONS

PCT International Search Report, dated Oct. 29, 2010, 15 pages.

*Primary Examiner* — Mark A Osele
*Assistant Examiner* — Nickolas Harm
(74) *Attorney, Agent, or Firm* — Abbey A. Lopez; Amy M. Foust; Charles R. Matson

(57) ABSTRACT

Apparatuses and methods for producing an absorbent article are provided. Generally, the apparatuses and methods allow for continuous delivering of a plurality of web material to downstream equipment during a manufacturing process. In some embodiments, the apparatuses and methods allow for simultaneously unwinding, splicing, and lamination of multiple rolls of web material rotatably mounted to a frame and delivering the web material to various downstream manufacturing processes.

12 Claims, 9 Drawing Sheets

(56) References Cited

FOREIGN PATENT DOCUMENTS

| | | | |
|---|---|---|---|
| DE | 10 2006 017379 | A1 | 10/2007 |
| EP | 0 589 859 | A1 | 3/1994 |
| EP | 1 174 377 | A2 | 1/2002 |
| EP | 1188426 | B1 | 10/2008 |
| WO | WO 00/38608 | A1 | 7/2000 |
| WO | WO 01/56523 | A1 | 8/2001 |
| WO | WO 01/56524 | A1 | 8/2001 |
| WO | WO 2005/005296 | A1 | 1/2005 |

* cited by examiner

SYSTEMS AND METHODS FOR CONTINUOUS DELIVERY OF WEB MATERIALS

FIELD OF THE INVENTION

The present disclosure generally relates to apparatuses and methods for continuous delivering of a plurality of web materials to downstream equipment, during a manufacturing process, and more particularly relates to apparatuses and methods for simultaneously unwinding multiple spools or rolls of web materials rotatably mounted to a frame and delivering the web materials to various downstream manufacturing processes.

BACKGROUND OF THE INVENTION

Along an assembly line, diapers and various types of other disposable absorbent articles may be assembled by adding components to and otherwise modifying an advancing, continuous web of material. The processing of web materials into products may include a process wherein the various web materials are unwound from a supply roll or spool and subsequently processed to form at least a portion of a disposable absorbent article. Webs of material and component parts used to manufacture disposable absorbent articles, such as diapers, training and pull-up pants, incontinence briefs and undergarments, cleaning and dusting devices, and feminine hygiene garments may include: backsheets, topsheets, absorbent cores, front and/or back ears, fastener components, and various types of elastic webs and components such as leg elastics, barrier leg cuff elastics, and waist elastics, for example. Due to the finite nature of any supply roll, it may be necessary to slow or stop the manufacturing process to replace an exhausted supply roll of the web material. Slowing or stopping an otherwise continuous process may be detrimental to process productivity and may adversely impact the costs associated with the manufacture of the finished process. Further, with products incorporating a variety of web materials that are each supplied to the process on a separate roll, a number of unwinding devices ("unwinders") or other ancillary equipment may be required to unwind the various rolls during the manufacturing process. Additionally, each unwinder may typically require a controller for controlling the activity of the unwinder.

SUMMARY OF THE INVENTION

In one non-limiting embodiment, an integral web material delivery module for delivering web material to a downstream process, comprises a frame, a first set of web material feed mandrels coupled to the frame, the first set of web material feed mandrels comprising a first web material feed mandrel and a second web material feed mandrel, where the first web material feed mandrel is configured to receive a roll of a first web material and the second feed mandrel is configured to receive a roll of a second web material. The integral web material delivery module may also comprise a first splicer coupled to the frame, the first splicer configured to splice the first web material and the second web material and a a second set of web material feed mandrels coupled to the frame, the second set of web material feed mandrels comprising a third web material feed mandrel and a fourth web material feed mandrel, where the third web material feed mandrel is configured to receive a roll of a third web material and the fourth feed mandrel is configured to receive a roll of a fourth web material. The integral web material delivery module may also comprise a second splicer coupled to the frame, the second splicer configured to splice the third web material and the fourth web material. In various embodiments, the integral web material delivery module may also comprise a third set of web material feed mandrels coupled to the frame, the third set of web material feed mandrels comprising a fifth web material feed mandrel and a sixth web material feed mandrel, where the fifth web material feed mandrel is configured to receive a roll of a fifth web material and the sixth feed mandrel is configured to receive a roll of a sixth web material. The integral web material delivery module may also comprise a third splicer coupled to the frame, the third splicer configured to splice the fifth web material and the sixth material, where the integral web material delivery module is configured to concurrently deliver the first web material to the downstream process, the second web material to the downstream process, and the third web material to the downstream process.

In another non-limiting embodiment, the integral web material delivery module of claim may also comprise a fourth set of web material feed mandrels coupled to the second face of the frame, the fourth set of web material feed mandrels comprising a seventh web material feed mandrel and an eighth web material feed mandrel, where the seventh web material feed mandrel is configured to receive a roll of a seventh web material and the eighth feed mandrel is configured to receive a roll of an eighth material, and a fourth splicer coupled to the frame, the fourth splicer configured to splice the seventh web material and the eighth web material.

In yet another non-limiting embodiment, a web material delivery apparatus comprises a frame, a set of web material feed mandrels coupled to the frame, the first set of web material feed mandrels comprising a first web material feed mandrel and a second web material feed mandrel, where the first web material feed mandrel is configured to receive a roll of a first web material and the second feed mandrel is configured to receive a roll of a second web material, a splicer coupled to the frame, the splicer configured to splice the first web material and the second web material, a third web material feed mandrel coupled to the frame; and a bonding assembly coupled to the frame, where the bonding assembly is configured to bond a web material from the splicer with a web material from the third web material feed mandrel.

In yet another non-limiting embodiment, a method of unwinding material may comprises the steps of unwinding at a first unwinding rate a first web material from a first roll rotatably mounted to a frame; delivering the first web material to a downstream converter at a first required rate of delivery; controlling with an electronic controller the first unwinding rate based on the first required rate of delivery; unwinding at a second unwinding rate a second web material from a second roll rotatably mounted to the frame; delivering the second web material to the downstream converter at a second required rate of delivery with the electronic controller; controlling with the electronic controller the second unwinding rate based on the second required rate of delivery; unwinding at a third unwinding rate a third web material from a third roll rotatably mounted to the frame; delivering the third web material to the downstream converter at a third required rate of delivery; and controlling with the electronic controller the third unwinding rate based on the third required rate of delivery.

BRIEF DESCRIPTION OF DRAWINGS

The above-mentioned and other features and advantages of the present disclosure, and the manner of attaining them, will become more apparent and the disclosure itself will be better understood by reference to the following description of non-limiting embodiments of the disclosure taken in conjunction with the accompanying drawings, wherein.

DETAILED DESCRIPTION OF THE INVENTION

Various non-limiting embodiments of the present disclosure will now be described to provide an overall understanding of the principles of the structure, function, manufacture, and use of the systems, apparatuses, accessories, and methods disclosed herein. One or more examples of these non-limiting embodiments are illustrated in the accompanying drawings. Those of ordinary skill in the art will understand that the systems, apparatuses, accessories, and methods specifically described herein and illustrated in the accompanying drawings are non-limiting example embodiments and that the scope of the various non-limiting embodiments of the present disclosure are defined solely by the claims. The features illustrated or described in connection with one non-limiting embodiment may be combined with the features of other non-limiting embodiments. Such modifications and variations are intended to be included within the scope of the present disclosure.

Aspects of the present disclosure relate to apparatuses and methods for continuous delivering of a plurality of web materials to downstream equipment during a manufacturing process, and more particularly relates to apparatuses and methods for simultaneously unwinding multiple rolls of web material rotatably mounted to a frame and delivering the web material to various downstream manufacturing processes. In the course of subsequent process steps the web material may be separated into individual or discrete web pieces and may form a part of a manufactured article. Such a structure is useful for disposable absorbent articles, such as, but not limited to, disposable baby diapers, training pants, adult incontinence article, feminine hygiene articles and the like. Such articles have varying requirements as to the desired absorbency depending on the intended use and/or user. In such embodiments, the web materials may be fluid permeable webs, such as non-woven material, or thermoplastic films, or thermoplastic-net let materials, for example. Although the description below is mainly related to absorbent articles, it is to be appreciated that the apparatuses and methods described herein are also applicable to other types of manufactured goods. As used herein, "machine direction" (MD) is used to refer to the direction of the web material flow through a process.

Figure 1:
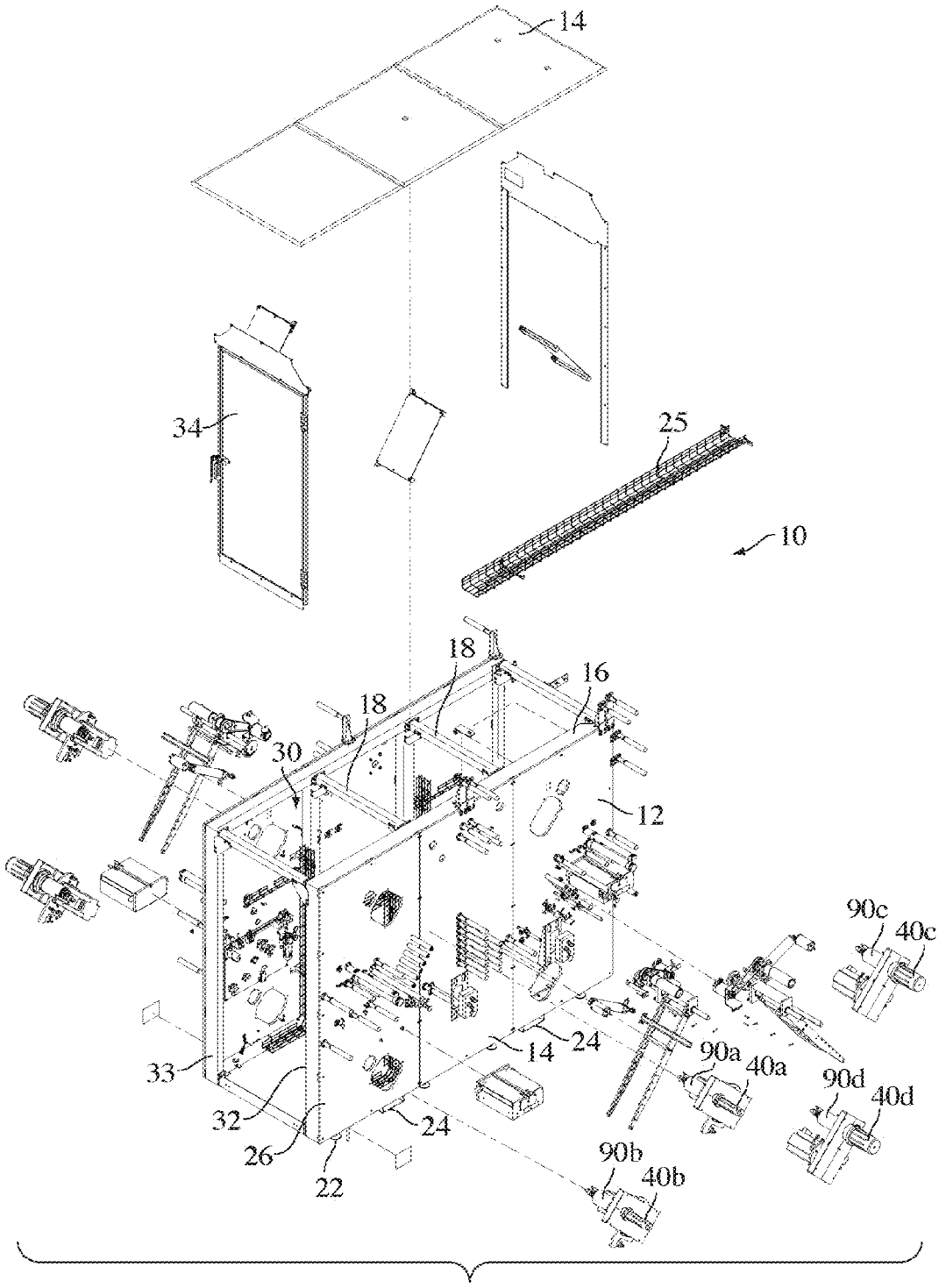
FIG. 1 is an exploded perspective view of an integral web material delivery module in accordance with one non-limiting embodiment.
Figure 2:
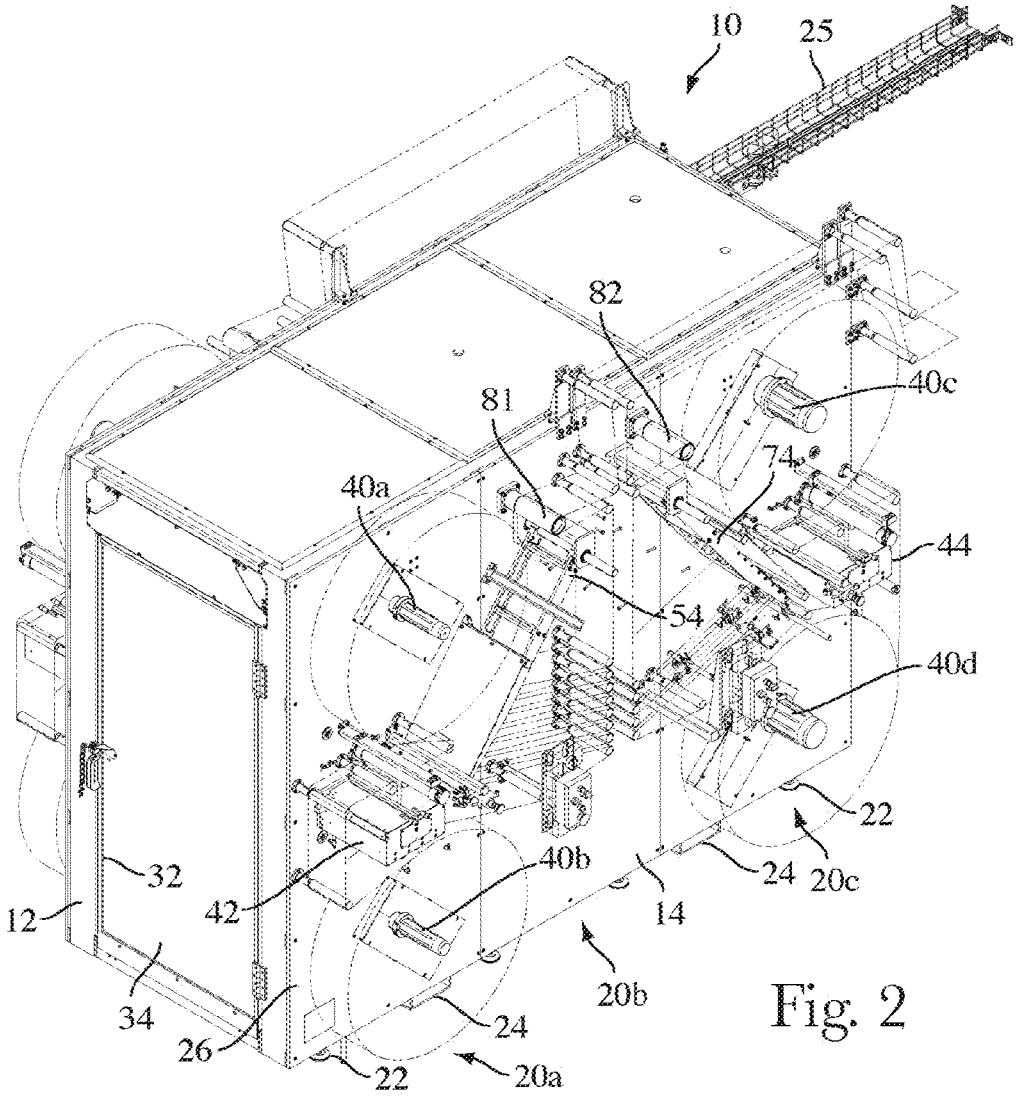
FIG. 2 is a perspective view of the integral web material delivery module of FIG. 1 in accordance with one non-limiting embodiment.
Figure 3:
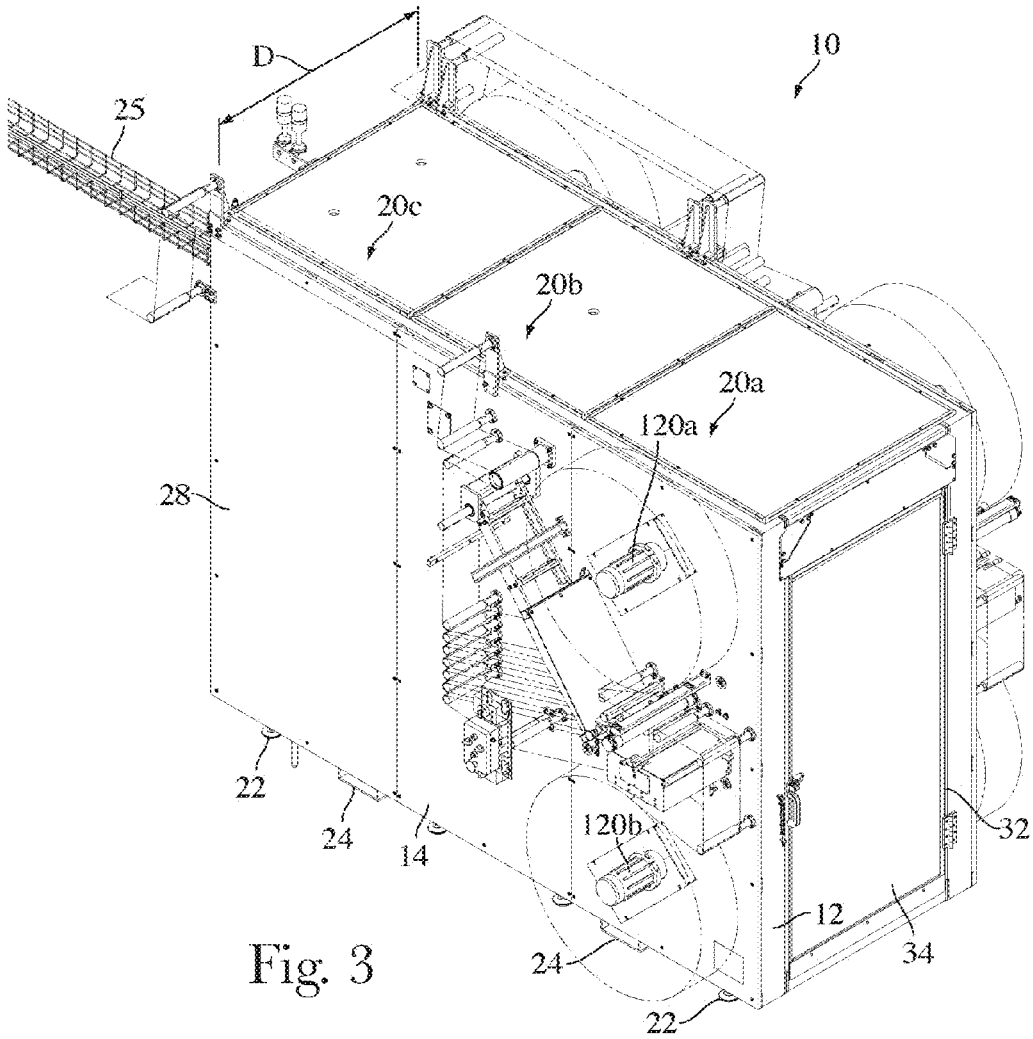
FIG. 3 is a perspective view of the integral web material delivery module of FIG. 1 in accordance with one non-limiting embodiment.

One embodiment of an integral web material delivery module 10 is illustrated in FIGS. 1-3. FIG. 1 is an exploded perspective view of the integral web material delivery module 10 in accordance with one non-limiting embodiment. FIG. 2 is a perspective view of the integral web material delivery module 10 in accordance with one non-limiting embodiment. FIG. 3 is another perspective view of the integral web material delivery module 10 in accordance with one non-limiting embodiment. The integral web material delivery module 10 may have a frame 12. The frame 12 includes various components, such as structural supports and plates. For example, the frame 12 may include a plurality of faceplates 14. The faceplates 14 may be fastened to a support member 16 of the frame 12, for example. The frame 12 may include at least one cross-support member 18. The frame 12 may be generally sectional, with three sections 20*a*, 20*b*, and 20*c* shown in the illustrated embodiment. It is appreciated, however, that other embodiments may comprise more or less sections. Furthermore, the sections may be arranged vertically (as illustrated) or in a horizontal arrangement, or a combination of both, for example. The integral web material delivery module 10 may be manufactured from any suitable materials, such as steel, stainless steel, aluminum or composite materials, for example. The integral web material delivery module 10 may also be assembled or constructed using any suitable techniques, such as welding, rivets, adhesives, or screws, for example.

The integral web material delivery module 10 may include a plurality of feet 22 arranged proximate the bottom side. As will be appreciated, the plurality of feet 22 may be adjustable in order to adjust the elevation of the integral web material delivery module 10. The integral web material delivery module 10 may also include a pair of fork slots 24 located proximate the bottom side. The fork slots 24 may receive forks on a tow motor and thereby allow for transport of the integral web material delivery module 10. Furthermore, the integral web material delivery module 10 may comprise a cable tray 25 for housing various power and communication cables. Other techniques may be used for housing the cables, such as conduits, for example.

In the illustrated embodiment, the integral web material delivery module 10 is generally rectangular. In various embodiments, other configurations may be used, such as a cube shape or a triangular shape, for example. The integral web material delivery module 10 may have a plurality of faces, including a first face 26 and a second face 28. As illustrated, the first face 26 and the second face 28 may be laterally opposed and separated by a distance "D" (FIG. 3). In various embodiments, distance "D" may be in the range of about 3 feet to 8 feet. A cavity 30 may be defined intermediate the first face 26 and the second face 28. While the cavity 30 in the illustrated embodiment is generally rectangular, it is to be appreciated that the cavity 30 may be a variety of shapes and may largely depend on the relationship of the various faces. For example, if the frame 12 is triangular, the cavity 30 may be generally triangular as well. The cavity 30 may be generally enclosed by the various plates 14 of the integral web material delivery module 10. In order to provide access to components and equipment within the cavity 30, the integral web material delivery module 10 may have at least one cavity access port 32. In one embodiment, a cavity access port 32 is provided intermediate the first face 26 and the second face 28 in an end face 33. In various embodiments, the cavity access port 32 may be located in other positions, such as in the first face 26 or the first face 28. Furthermore, a door 34 may be mounted in the cavity access port 32 to control access to the cavity 30. In one embodiment, the door 34 is sized to allow a person to enter the cavity 30. Various embodiments may comprise a plurality of doors 34 and a plurality of cavity access ports 32.

Figure 4:
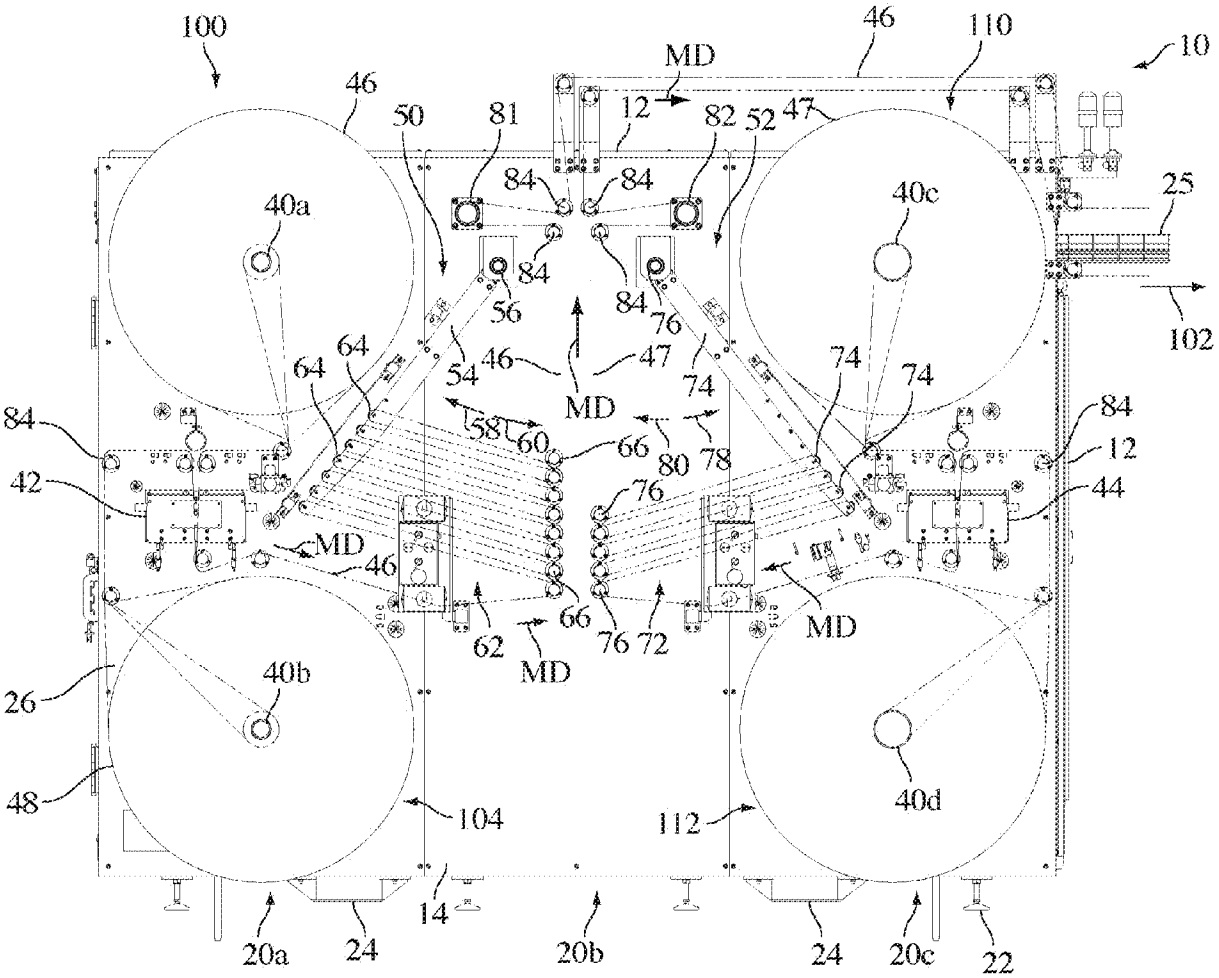
FIG. 4 is a side view of the integral web material delivery module of FIG. 1 in accordance with one non-limiting embodiment.

FIG. 4 illustrates a side view of the integral web material delivery module 10 in accordance with one non-limiting embodiment. The integral web material delivery module 10 may comprise a plurality of mandrels 40*a*, 40*b*, 40*c*, 40*d* extending from a face of the integral web material delivery module 10, such as the first face 26. The mandrels 40*a*, 40*b*, 40*c*, 40*d* may extend generally perpendicular to the first face 26, or may be positioned at any other suitable angle. In some embodiments, the integral web material delivery module 10 may include a first splicer 42, and some embodiments may also include a second splicer 44. The first splicer 42 and the second splicer 44 may be positioned on the integral web material delivery module 10 in any suitable location, such as in between a pair of mandrels. As illustrated in FIG. 4, the first splicer 42 may be configured to receive a web material 46 and a web material 48. Similarly, the second splicer 44 may be configured to receive a web material 46 and a web material 48. The integral web material delivery module 10 may further comprise a first dancer 50, and, if needed, a second dancer 52. The first dancer 50 may comprise an arm 54 that is mounted to the frame at a joint 56. The arm 54 may be pivotable in a first direction indicated by arrow 58 and a second direction indicated by arrow 60. The first dancer 50 may also comprise a first lattice 62. The first lattice 62 may comprise a plurality of rollers 64 mounted to the arm 54 and a complimentary plurality of rollers 66 mounted to the frame 12. As is to be appreciated, the number of rollers 64, 66 in the first lattice 62 may vary depending on the type of web material being fed through the first lattice 62 and the feed speed of the web material. The second dancer 52 may have similar components, such as an arm 74 that pivots about a joint 76 in a first direction 78 and a second direction 80. Similar to the first dancer 50, the second dancer 52 may comprise a second lattice 72 comprises a plurality of rollers 74 mounted to the arm 74 and a plurality of rollers 76 mounted to the frame 12. As described in more detail below, the number of rollers in the first lattice 62 may differ from the number of rollers in the second lattice 72, as the number of rollers used is based on characteristics of the web material being fed through the lattices 62, 72, such as web material 47.

In some embodiments, the integral web material delivery module 10 may comprise a first metering roll 81 and a second metering roll 82. The first and second metering rolls 81, 82 may be driven by an actuator to establish a line speed and/or line tension of the web material. The integral web material delivery module 10 may further comprise a plurality of spindles 84 or idler rollers to engage and direct the web material. As is to be appreciated, the various spindles 84 may rotate relative or may be fixed.

The various mandrels, spindles, and metering rolls may be powered by any motive force known in the art, collectively referred to herein as "actuators." Power sources include, without being limiting, standard and servo electric motors, air motors, and hydraulic motors. The power source may be coupled to any rotating components of the integral web material delivery module 10 by any power transfer means known in the art, such as direct coupling the actuator to the rotating component, driving the rotating component through the use of chains and sprockets, belts and sheaves, and gearing, for example. In one embodiment, as illustrated in FIG. 1, actuators 90*a*, 90*b*, 90*c*, 90*d* are operably engaged to each mandrel 40*a*, 40*b*, 40*c*, 40*d*. In other embodiments, however, a single actuator may be used to drive a plurality of mandrels. The actuators 90*a*, 90*b*, 90*c*, 90*d* may extend into the cavity 30 of the integral web material delivery module 10. Various power and communication cables may be attached to the actuators 90*a*, 90*b*, 90*c*, 90*d* inside the cavity 30.

In one embodiment, referring to FIG. 4, a roll 100 of the first web material 46 may be mounted on the mandrel 40*a*. The roll 100 may be rotatable in either a clockwise and/or counter clockwise direction. The web material 46 may be unwound from the roll 100 and fed into and pass through the splicer 42. Once passing through the splicer 42, the web material 46 may enter the first lattice 62. As illustrated, the web material 46 may be looped over a roller 66 that is fixed relative to the arm 54 and then extend to a roller 64 that is mounted to the arm 54. The web material 46 may then extend between a series of complimentary rollers in the first lattice 62 thereby forming a "festoon." As will be appreciated upon consideration of this disclosure, when the arm moves (or pivots) in the direction 58 the distance between the rollers 64 and the rollers 66 increases, thereby increasing the linear amount of the web material 46 engaged in the first lattice 62. Additionally, the number of rollers 64, 66 used in the first lattice 62 will also determine the linear amount of the web material 46 engaged in the first lattice 62. After passing through the first lattice 62, the web material 46 may proceed in the machine direction towards the first metering roll 81. After engaging with first metering roll 81, the web material 46 may be directed toward downstream equipment, as indicated by arrow 102.

A roll 104 of the web material 48 may be mounted to the mandrel 40*b*. The roll 104 may be configured to rotate in a clockwise and/or counterclockwise direction. In the illustrated embodiment, the roll 104 serves as a stand-by roll for the splicer 42, and therefore the web material 48 may be the same type of the web material as 46. In other embodiments, however, the roll 104 may bypass the splicer 42 and/or may be a different web material than web material 46. As used herein, splicing refers to the process of joining a first web material to a second web material, such as joining the web material 46 from roll 100 to the web material 48 from the roll 104. As used herein, a splice is considered to be the combined localized portions of a first web material and a second web material that are joined together.

Web material that may be spliced include, without being limiting, non-woven materials, paper webs including tissue, towel and other grades of paper, absorbent materials, plastic films and metal films. The splicer 42 may be adapted to splice the web material of any suitable width and thickness. Web material ranging in width from a few millimeters to about several meters may be processed by an appropriately sized splicing apparatus. Similarly, web material ranging in thickness from a few thousandths of a millimeter to several millimeters may be spliced by an appropriately adapted splicer 42. Additional detailed descriptions of various types of splicing methods and apparatuses can be found in U.S. Pat. Nos. 7,128,795 and 5,514,237, which are incorporated by reference in their entirety.

During operation, the splicer 42 may perform a zero-speed splice of a tail end of the web material 46 on roll 106 to the beginning end of the web material 48 on roll 104 while simultaneously continuing to deliver the web material 46 to the downstream equipment. During a splicing operation, the arm 54 may move in the direction 58 in order to serve as an accumulator and increase the linear amount of the web material 46 engaged in the first lattice 62. When the roll 104 stops spinning, the arm 54 moves or pivots in the direction 60 and the web material 46 is drawn out of the first lattice 62 to supply the downstream equipment. Therefore, the splicer 42 may splice the web material 46 to the web material 48 while the rolls are stopped, yet the web material 46 continues to be delivered from the integral web material delivery module 10 to downstream equipment without disruption. Once the splice has been performed, the mandrel 40*b* may be rotated by the actuator 90*b* to unwind the web material 48 from the roll 104. As will be appreciated, once the web material 48 is unwinding from the roll 104 and supplying web material to the downstream equipment, a replacement roll may be loaded onto mandrel 40*a*, with material from that replacement roll fed into the splicer 42 and positioned to serve as a standby roll.

It should be understood that first and second web materials 46, 48, such as thermoplastic material, can be added to the line operation in an alternating fashion in the above described manner whenever a low roll amount is detected, thereby allowing the line to run continuously. It should also be understood that while the method and apparatus of the present invention have been described with reference to first and second web materials, it is intended that multiple rolls of web materials will be spliced together over time to keep the line running. Further, it is contemplated that the first and second web materials need not be made from the same web material as long as the web materials used for the first and second webs are compatible from a splicing standpoint. Due to the ability to continuously run the line operation according to the teachings of the present invention, products can be manufactured with minimal manufacturing down-time.

The splice between the web material 46 and the web material 48 may be accomplished by any means known in the art. The nature of the splice may be related to the nature of the particular web material being spliced. In one embodiment two webs are spliced together by using two-sided splicing tape having adhesive on each side of the tape. In this embodiment, the two-sided splicing tape is affixed first to one web material and then to the second web material. Pressure may be applied to the portion of the two web material after the application of the two-sided splicing tape.

In another embodiment web material may be joined by applying an adhesive directly to one web material and then bringing the second web material into contact with the adhesive. Pressure may be applied to the two web materials at the location of the adhesive to assist in the joining of the web material.

In another embodiment the two web materials may be brought into a face to face relationship and then subjected to sufficient pressure to bond the two web materials together. In this embodiment, the two web materials may be subjected to sufficient pressure to glassine the two web materials creating a bond sufficient to withstand the process tension applied to the spliced web material.

In another embodiment the two web materials may be brought into a face to face relationship and exposed to a bonding means. Bonding means include without being limiting, exposure to infra red or other electromagnetic radiation to heat and fuse the webs, ultrasonic energy applied from an appropriately adapted ultrasonic horn to the combined web material against an anvil to heat and fuse the material, and the spray application of a solvent to fuse the webs.

In one embodiment, still referring to FIG. 4, the integral web material delivery module 10 may support additional rolls, such as rolls 110, 112. In various embodiments, rolls 110, 112 may be configured to operate substantially similar to rolls 100, 104. For instance, roll 110 may serve as a supply roll and roll 112 may serve as a standby roll. When roll 110 is nearly depleted, the splicer 44 may splice the beginning portion of roll 112 to the tail of roll 110. The second lattice 72 may be configured to operate similarly to the first lattice 62 in order to aid in the continuous delivery of web material to downstream equipment. While rolls 100, 104, 110, 112 are shown, it is to be appreciated that more or less rolls may be used in various embodiments. For example, some embodiments of the integral web material delivery module 10 may include additional vertical sections to accommodate an additional roll or additional rolls. Furthermore, in various embodiments, the integral web material delivery module 10 may include mandrels on other faces that are configured to receive rolls of web material. In one embodiment, as shown in FIG. 3, the second face 28 may comprise a set of mandrels 120*a*, 120*b*. Rolls of web material may be mounted on the mandrels 120*a*, 120*b* and during operation downstream equipment may be continuously fed with web material from at least one of the rolls. FIG. 3 illustrates that the second face 28 of the vertical section 20*c* may not contain any mandrels; however, it is to be appreciated that in some embodiments the second face 28 of vertical section 20*c* may comprise at least one mandrel configured to receive a roll of web material. Further, in some embodiments, the second face 28 of vertical section 20*c* may comprise at least two mandrels, with each mandrel configured to receive a roll of web material. Additionally, the second face 28 of vertical section 20*c* may comprise a splicer, similar to splicer 42, for example.

The integral web material delivery module 10 may be positioned in a manufacturing environment proximate to other manufacturing apparatuses. While no particular downstream equipment is shown, it will be understood that the continuous webs of web material supplied by integral web material delivery module 10 could be advanced to a variety of web material handling processes, including without being limiting, laminating operations, printers, embossing operations, slitting, folding and cutting operations, converting operations, and combinations of these.

Figure 5:
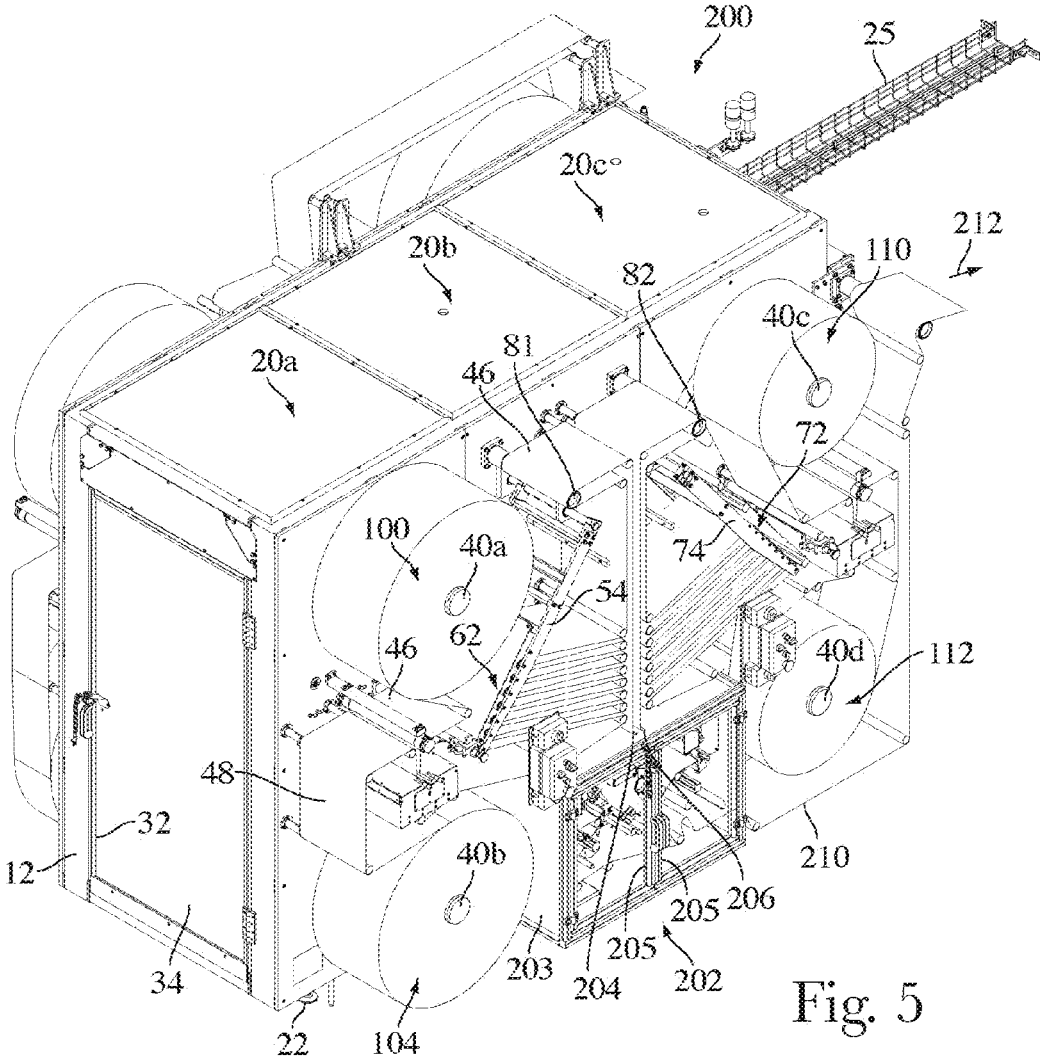
FIG. 5 is a perspective view of an integral web material delivery module comprising a lamination station in accordance with one non-limiting embodiment.
Figure 6:
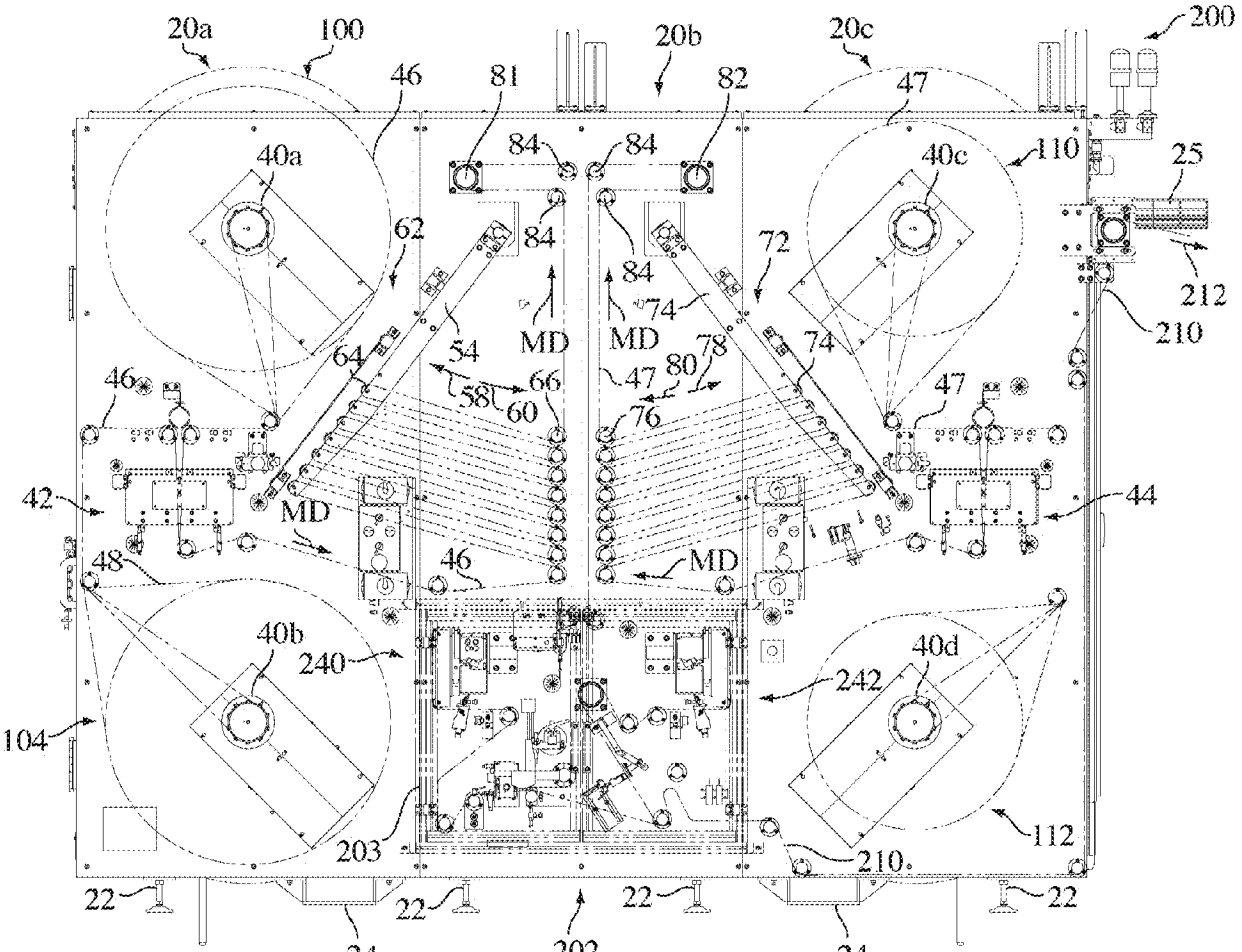
FIG. 6 is a side view of the integral web material delivery module of FIG. 5 in accordance with one non-limiting embodiment.

FIGS. 5 and 6 illustrate one embodiment of an integral web material delivery module 200. FIG. 5 is a perspective view of the integral web material delivery module 200 in accordance with one non-limiting embodiment. FIG. 6 is a side view of the integral web material delivery module 200 in accordance with one non-limiting embodiment. The integral web material delivery module 200 may have similar features to the previously described embodiments and such features are numbered with the same reference numbers. The integral web material delivery module 200 may further comprise a lamination station 202. The lamination station 202 may be positioned in any suitable location on the integral web material delivery module 200 and may be configured to receive web material from the various rolls mounted to the integral web material delivery module 200. As illustrated, the lamination station 202 may be positioned downstream of the first lattice 62 and the second lattice 72. The lamination station 202 may be contained in a cabinet 203 having at least one door 205. In one embodiment, the lamination station 202 may be configured to receive two different web materials, such as web material 46 and web material 47. Web material 46 may be received into the lamination station 202 through a first slot 204 and web material 47 may be received into the lamination station 202 through a second slot 206.

The web material 46 and 47 may be laminated together in the lamination station 202 to form a laminated web material 210. The lamination can be achieved using known chemical, thermal, or mechanical means, or any combination thereof. Chemical means employ the use of adhesives, resins, binders, and the like for adhesively laminating the layers. Thermal means employ heat so as to melt and thus fuse layers of the web materials. Mechanical means employ, for example, pressure to compressively laminate the layers together. Further, in some embodiments, the lamination may be achieved with crimping, ultrasonics or static electricity, for example. Laminating web materials may include polymers selected from the group consisting of polyethylene, polypropylene, polybutylene, polyisobutylene, and mixtures thereof.

The lamination station 202 may be comprised of a first material web delivery portion 240 and a second material web delivery portion 242. Upon entry into the lamination station 202, web material 46 and 47 may be tracked actively in the cross machine direction (CD) to insure proper alignment by a first and a second web tracking device, respectively. In one embodiment, to produce the laminated web material 210, a layer of the polymeric web material (e.g. powdered polyethylene) is applied to one side of the web material 46 and/or web material 47, which is then heated to melt the polyethylene and brought together with the other layer and compressed until laminated. Alternatively, both web material 46, 47 can first be brought together and heated and compressed until the two web material 46, 47 have been laminated to form laminated web material 210. In one embodiment, a chemical bonding agent, such as an adhesive, may be applied to material web 46 and material web 47. The material webs 46 and 47 may then be brought into contact to complete the lamination of the two material webs into a new laminated web material 210. Once the web materials have been laminated, the resulting laminated web material 210 may be directed toward downstream equipment, as indicated by arrow 212. While integral web material delivery module 200 illustrates a single lamination station 202, it is to be appreciated that various embodiments may have a plurality of lamination stations 202.

Figure 7:
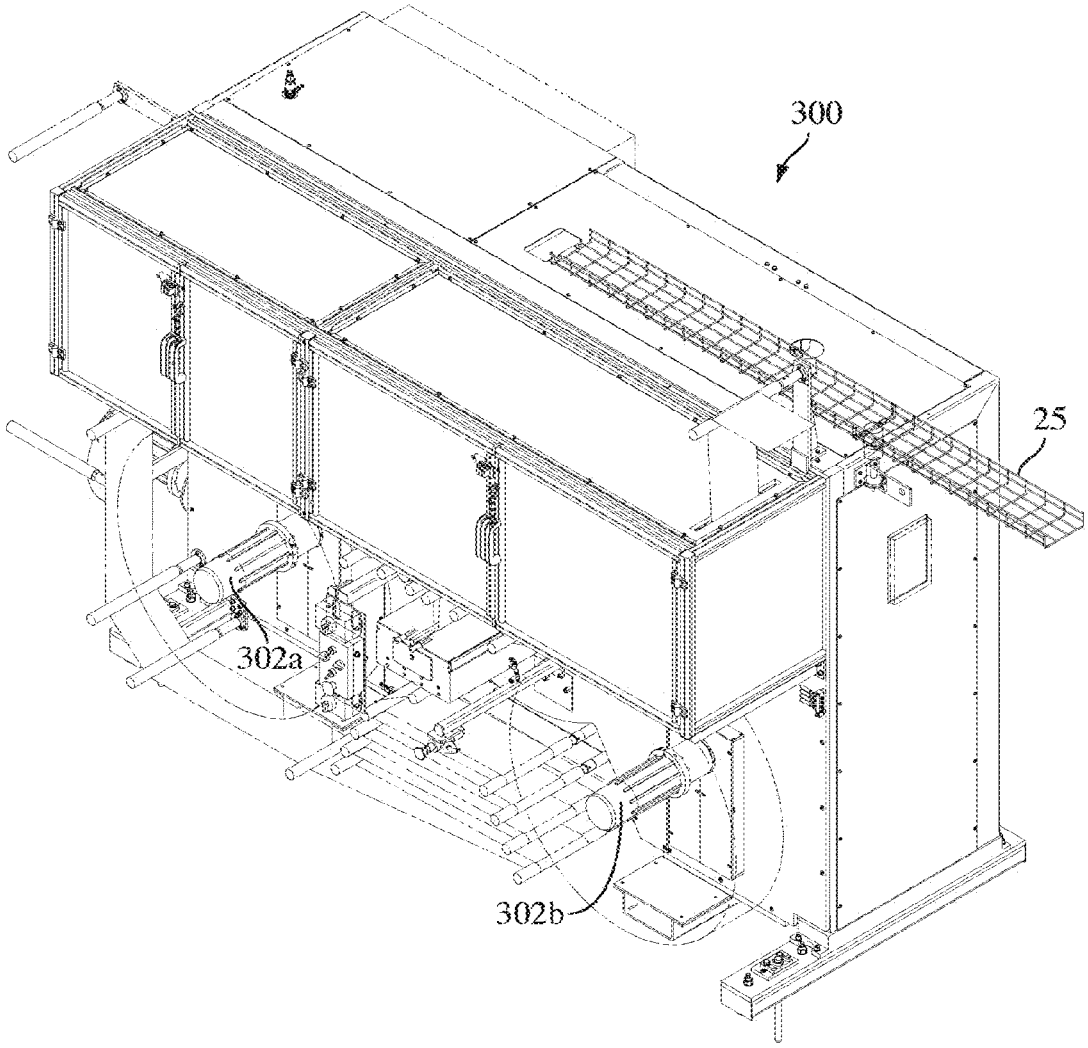
FIG. 7 is a perspective view of an integral web material delivery module in accordance with one non-limiting embodiment.
Figure 8:
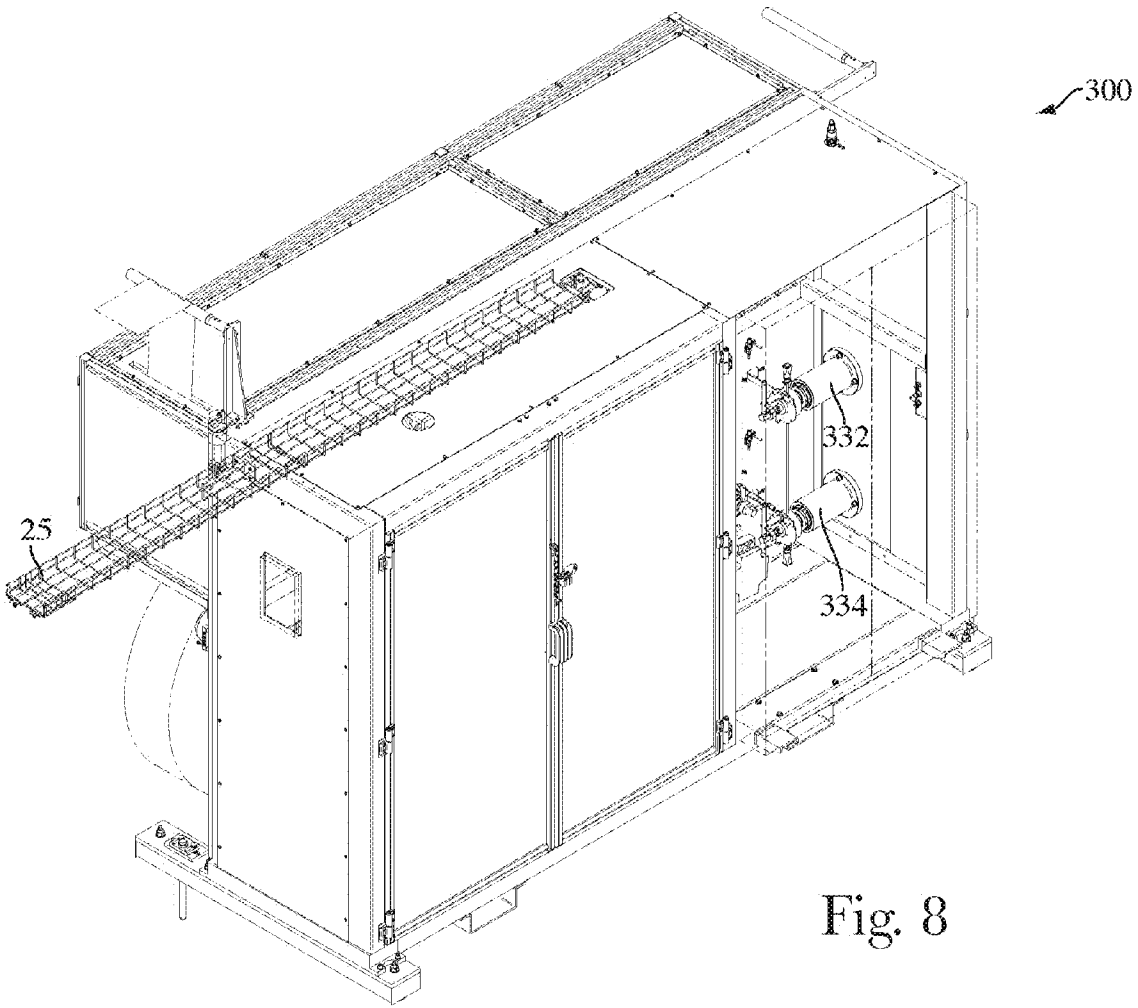
FIG. 8 is a perspective view of the integral web material delivery module of FIG. 7 in accordance with one non-limiting embodiment.
Figure 9:
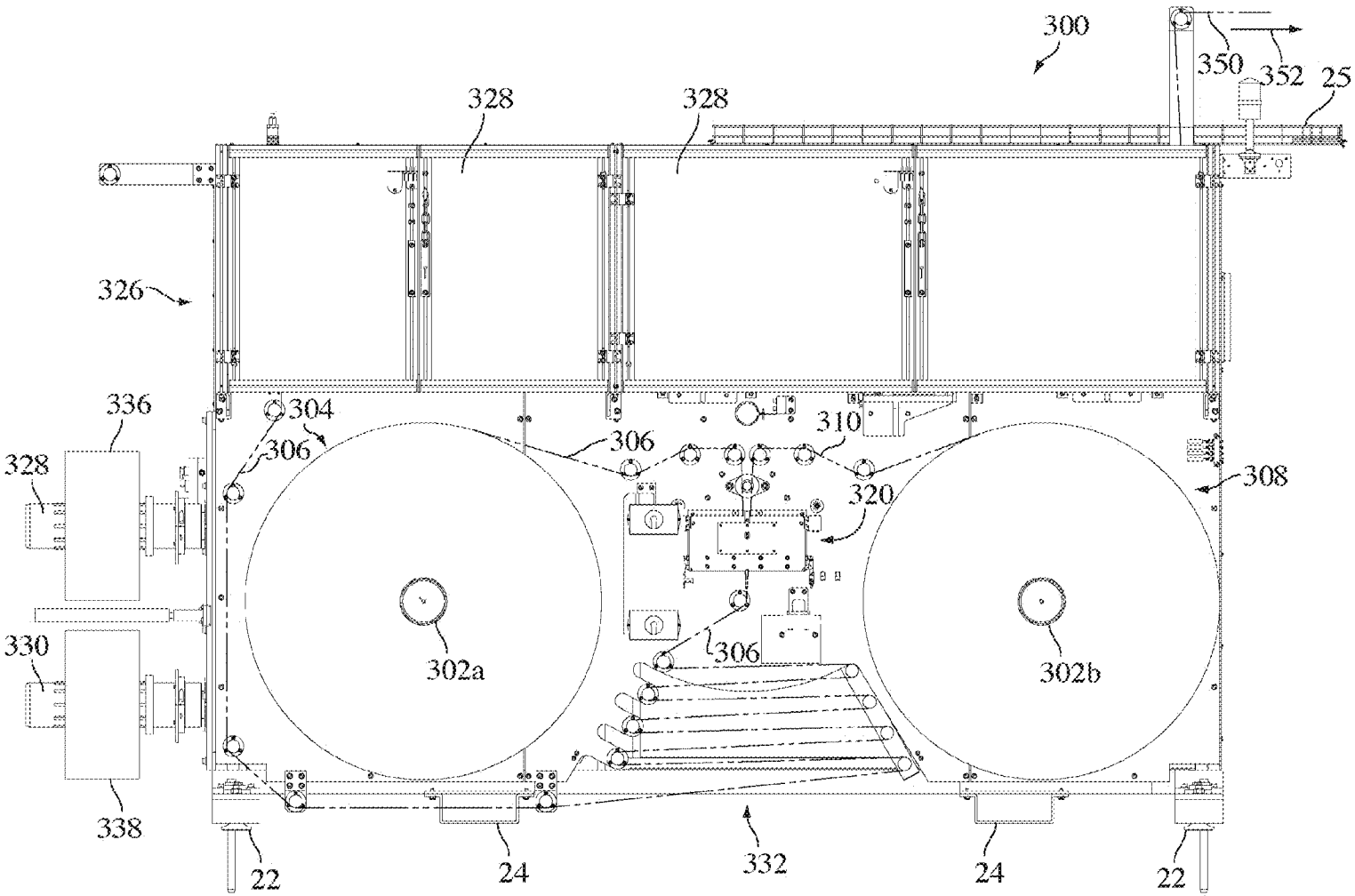
FIG. 9 is a side view of the integral web material delivery module of FIG. 7 in accordance with one non-limiting embodiment.

FIGS. 7, 8 and 9 illustrate one embodiment of an integral web material delivery module 300. FIG. 7 is a perspective view of the integral web material delivery module 300 in accordance with one non-limiting embodiment. FIG. 8 is another perspective view of the integral web material delivery module 300 in accordance with one non-limiting embodiment. FIG. 9 is a side view of the integral web material delivery module 300 in accordance with one non-limiting embodiment. The integral web material delivery module 300 may have similar features to the previously described embodiments and such features are numbered with the same reference numbers. As illustrated, the integral web material delivery module 300 may comprises a set of mandrels 302*a*, 302*b*. Similar to previously described embodiments, each mandrel 302*a*, 302*b* may be rotated by an actuator. Each mandrel 302*a*, 302*b* may be configured to receive a roll of web material. For example, mandrel 302*a* may receive a roll 304 of the web material 306 and mandrel 302*b* may receive a roll 308 of web material 310. Similar to previously discussed embodiments, one roll may serve as a running roll while the other roll may serve as a standby roll. Each web material 306 and 310 may be fed into a splicer 320. If roll 308 is serving as a standby roll, a beginning portion of the web material 306 is fed into a lattice 322 in preparation for splicing. As is to be appreciated, the lattice 322 may function similarly to the first lattice 62 and the second lattice 72. After passing through the lattice 322, the web material may enter a transformation station 326. In one embodiment, the transformation station 326 comprises a series of cabinets 328 mounted across the top of the integral web material delivery module 300. It is appreciated, however, that other embodiments may implement the transformation station 326 using varying techniques. For example, a plurality of transformation stations 326 may be implemented.

In one embodiment, as illustrated in FIG. 9, the integral web material delivery module 300 may comprise first and second auxiliary mandrels 328, 330. The auxiliary mandrels 328, 330 may each be driven with an actuator, such as actuators 332, 334 illustrated in FIG. 8. In some embodiments, however, mandrels 328, 330 may be fixed and not rotate. In such embodiments, a roll of the web material placed on the mandrel may be unwound by pulling the web material off the roll, as opposed to rotating the mandrel. As illustrated, a roll 336 may be placed on mandrel 328 and a roll 338 may be placed on mandrel 330. In one embodiment, the roll 336 is a roll of hook and loop and the web of hook and loop fasteners are received by the transformation section 326. In addition to receiving the web material 306, the transformation station 326 may also receive various web materials from at least one auxiliary mandrel.

Various transformations to the web material 306 may occur in the transformation station 326 of the integral web material delivery module 300. For example, the web material 306 may be laminated with the web material mounted onto one of the auxiliary mandrels 328, 330, the web material 306 may be folded, cut, shaped, stretched, combined with other web material or components, or otherwise transformed. Upon being transformed, the transformed web material 350 may be delivered to downstream equipment, as indicated by arrow 352.

As described in more detail above, the integral web material delivery module may simultaneously deliver a plurality of web materials to downstream equipment. As is to be appreciated, multiple integral web material delivery modules may be configured to all simultaneously supply web material to a single downstream manufacturing process and/or a plurality of downstream manufacturing processes. The line speed of the individual web material feeds may be determined by a master speed signal. Some web materials may be fed to the downstream manufacturing process at one speed, while other web materials are fed to the downstream manufacturing process at a fraction of that speed. In order to regulate and control the web material line speed the integral web material delivery module may continuously make adjustments to various components. For example, with reference to the integral web material delivery module 10 illustrated in FIG. 1-4, the speed of the actuators 90*a*, 90*b*, 90*c*, 90*d* and the speed of first and second metering rolls 81, 82 may be continually adjusted during operation. Furthermore, the dancers 50, 52 may selectively pivot or move to increase or decrease line tension. It is to be appreciated that any suitable driving technique may be used to pivotally rotate or otherwise move the dancers 50, 52. First and second lattices 62, 72 may serve has accumulators during a zero-speed splice and may also serve as part of the dancers 50, 52 to alter the line tension of the web material. As is to be appreciated, the integral web material delivery module may comprise a variety of sensors to determine roll diameter and material tension for example. A controller, or plurality of controllers, may be used to receive various inputs from the sensors on manufacturing line and the integral web material delivery module 10 and make adjustments as needed in a continuous and ongoing fashion. Additional detailed descriptions of various types control methods and apparatuses can be found in U.S. Pat. Nos. 6,991,144 and 7,028,940 which are incorporated by reference in their entirety.

It is to be appreciated that the apparatuses and methods disclosed herein may be utilized with various different types and aspects of methods and apparatuses relating to converting lines, such as, for example, described in the U.S. patent application identified by Ser. No. 12/544,363, entitled "RECONFIGURABLE CONVERTING LINE FOR FABRICATING ABSORBENT ARTICLES," filed on Aug. 20, 2009; U.S. patent application identified by Ser. No. 12/544,302, entitled "MODULAR CONVERTING LINE FOR FABRICATING ABSORBENT ARTICLES," filed on Aug. 20, 2009; U.S. patent application identified by Ser. No. 12/544,291, entitled "FLEXIBLE MANUFACTURING SYSTEMS AND METHODS," filed on Aug. 20, 2009; and U.S. patent application identified by Ser. No. 12/544,346, entitled "SPEED CHANGE KIT FOR AN ABSORBENT ARTICLE CONVERTING LINE," filed on Aug. 20, 2009, all of which are incorporated by reference herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An integral web material delivery module for delivering web material to a downstream process, comprising:

a frame;

a first set of web material feed mandrels coupled to the frame, the first set of web material feed mandrels comprising a first web material feed mandrel and a second web material feed mandrel, wherein the first web material feed mandrel is configured to receive a roll of a first web material and the second feed mandrel is configured to receive a roll of a second web material;

a first splicer coupled to the frame, the first splicer configured to splice the first web material and the second web material;

a second set of web material feed mandrels coupled to the frame, the second set of web material feed mandrels comprising a third web material feed mandrel and a fourth web material feed mandrel, wherein the third web material feed mandrel is configured to receive a roll of a third web material and the fourth feed mandrel is configured to receive a roll of a fourth web material;

a second splicer coupled to the frame, the second splicer configured to splice the third web material and the fourth web material;

a third set of web material feed mandrels coupled to the frame, the third set of web material feed mandrels comprising a fifth web material feed mandrel and a sixth web material feed mandrel, wherein the fifth web material feed mandrel is configured to receive a roll of a fifth web material and the sixth feed mandrel is configured to receive a roll of a sixth web material;

a third splicer coupled to the frame, the third splicer configured to splice the fifth web material and the sixth material, wherein the integral web material delivery module is configured to concurrently deliver the first web material to the downstream process, the second web material to the downstream process, and the third web material to the downstream process, wherein the first web material feed mandrel is operatively engaged with a first actuator, wherein the second web material feed mandrel is operatively engaged with a second actuator, wherein the third web material feed mandrel is operatively engaged with a third actuator, wherein the fourth web material feed mandrel is operatively engaged with a fourth actuator, wherein the fifth web material feed mandrel is operatively engaged with a fifth actuator, and wherein the sixth web material feed mandrel is operatively engaged with a sixth actuator, wherein the first actuator, the second actuator, the third actuator, the fourth actuator, the fifth actuator, and the sixth actuator are controlled by a single electronic controller, wherein the frame comprises first and second laterally opposed faces, wherein the first and second faces are separated by a distance, wherein the first and second sets of web material feed mandrels extend perpendicular from the first face and the third set of web material feed mandrels extends perpendicular from the opposing, second face, wherein a cavity is located intermediate the pair of laterally opposed faces, and wherein the first, second, third, fourth, fifth, and sixth actuators extend into the cavity.

2. The integral web material delivery module of claim 1, further comprising a first accumulator having a plurality of rollers and configured to receive a web material from the first splicer, and wherein the first accumulator is movable between a first position and a second position.

3. The integral web material delivery module of claim 2, further comprising a second accumulator having a plurality of rollers and configured to receive a web material from the second splicer, and wherein second accumulator is movable between a first position and a second position.

4. The integral web material delivery module of claim 3, further comprising a third accumulator having a plurality of rollers and configured to receive a web material from the third splicer, and wherein the third accumulator is movable between a first position and a second position.

5. The integral web material delivery module of claim 4, further comprising a fourth set of web material feed mandrels coupled to the same face of the frame as the third set of web material feed mandrels, the fourth set of web material feed mandrels comprising a seventh web material feed mandrel and an eighth web material feed mandrel, wherein the seventh web material feed mandrel is configured to receive a roll of a seventh web material and the eighth feed mandrel is configured to receive a roll of an eighth material, the integral web material delivery module further comprising a fourth splicer coupled to the frame, the fourth splicer configured to splice the seventh web material and the eighth web material.

6. The integral web material delivery module of claim 5, further comprising a laminator coupled to the frame, the laminator configured to receive a web material from the third splicer and a web material from the fourth splicer.

7. The integral web material delivery module of claim 6, wherein the seventh web material feed mandrel is operatively engaged with a seventh actuator, wherein the eighth web material feed mandrel is operatively engaged with an eighth actuator, wherein the seventh and eight actuators extend into the cavity.

8. The integral web material delivery module of claim 7, further comprising a fourth accumulator having a plurality of rollers and configured to receive a web material from the fourth splicer, and wherein the fourth accumulator is movable between a first position and a second position.

9. The integral web material delivery module of claim 6, wherein the first web material is the same as the second material, wherein the third web material is the same as the fourth material, wherein the fifth web material is the same as the sixth material, and the seventh web material is the same as the eighth material.

10. The integral web material delivery module of claim 1, further comprising a laminator coupled to the frame, the laminator configured to receive a web material from the first splicer and a web material from the second splicer.

11. The integral web material delivery module of claim 1, wherein:

the first actuator is configured unwind the first web material at a first speed;

the second actuator is configured to unwind the second web material at a second speed;

the third actuator is configured to unwind the third web material at a third speed;

the fourth actuator is configured to unwind the fourth web material at a fourth speed;

the fifth actuator is configured to unwind the fifth web material at a fifth speed; and the sixth actuator is configured to unwind the sixth web material at a sixth speed, wherein the first speed is different than the third speed and the fifth speed.

12. A web material delivery apparatus, comprising:

a frame;

a set of web material feed mandrels coupled to the frame, the first set of web material feed mandrels comprising a first web material feed mandrel and a second web material feed mandrel, wherein the first web material feed mandrel is configured to receive a roll of a first web material and the second feed mandrel is configured to receive a roll of a second web material;

a splicer coupled to the frame, the splicer configured to splice the first web material and the second web material;

a third web material feed mandrel coupled to the frame; and a bonding assembly coupled to the frame, wherein the bonding assembly is configured to bond a web material from the splicer with a web material from the third web material feed mandrel, wherein the first web material feed mandrel is operatively engaged with a first actuator, and wherein the second web material feed mandrel is operatively engaged with a second actuator, wherein the frame comprises a first face and second face, wherein the first face is laterally opposed to the second face, wherein the first and second faces are separated by a distance, wherein the first set of web material feed mandrels extends perpendicular from the first face and the third web material feed mandrel extends perpendicular from the opposing, second face, and a cavity located intermediate the first and second faces, wherein the first and second actuators extend into the cavity.

* * * * *